US008232037B2

(12) United States Patent
Iraqi et al.

(10) Patent No.: US 8,232,037 B2
(45) Date of Patent: Jul. 31, 2012

(54) LIQUID DEVELOPERS WITH UV CURABLE ADDITIVES AND METHODS FOR THEIR PREPARATION

(75) Inventors: Muhammad Iraqi, Rehovot (IL); Albert Teishev, Ness Ziona Rehovot (IL); Gregory Katz, Ness Ziona Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 595 days.

(21) Appl. No.: 12/442,391

(22) PCT Filed: Oct. 31, 2006

(86) PCT No.: PCT/US2006/042404

§ 371 (c)(1), (2), (4) Date: Mar. 27, 2009

(87) PCT Pub. No.: WO2008/036099

PCT Pub. Date: Mar. 27, 2008

(65) Prior Publication Data

US 2009/0324269 A1 Dec. 31, 2009

Related U.S. Application Data

(63) Continuation-in-part of application No. 11/524,019, filed on Sep. 20, 2006, now Pat. No. 7,544,458, and a continuation-in-part of application No. PCT/US2005/026627, filed on Jul. 27, 2005.

(51) Int. Cl.
*G03G 9/08* (2006.01)

(52) U.S. Cl. ..... 430/115; 430/118.6; 430/117.5; 430/137.22

(58) Field of Classification Search ..... 430/115, 430/118.6, 117.5, 137.22
See application file for complete search history.

(56) References Cited

U.S. PATENT DOCUMENTS

| | | | | |
|---|---|---|---|---|
| 5,212,526 | A | 5/1993 | Domoto | |
| 5,547,804 | A | 8/1996 | Nishizawa | |
| 6,837,839 | B2 | 1/2005 | Payne | |
| 2003/0086735 | A1 | 5/2003 | Payne | |
| 2004/0091808 | A1 * | 5/2004 | Qian et al. | 430/114 |

FOREIGN PATENT DOCUMENTS

| | | | |
|---|---|---|---|
| DE | 19511476 | A | 11/1995 |
| EP | 1607799 | A | 12/2005 |
| JP | 61-156262 | A | 7/1986 |
| JP | 62-098364 | A | 5/1987 |
| JP | 06-056946 | A | 3/1994 |
| WO | 94/06059 | A | 3/1994 |
| WO | 2005/109110 | A | 11/2005 |

OTHER PUBLICATIONS

International Search Report; PCT Patent Application No. PCT/US2006/042404, filed Oct. 31, 2006; search issued by European Patent Office (ISA) May 2, 2007.

* cited by examiner

*Primary Examiner* — Mark A Chapman

(57) ABSTRACT

A method for printing a substrate by liquid developer electrography, the method comprising: (a) developing a latent image with liquid developer comprising toner particles dispersed in a carrier liquid, said toner particles comprising UV-curable additive; (b) transferring the developed image to the substrate; (c) at least partially fixing the image to the substrate; and (d) irradiating the at least partially fixed image with UV radiation to cure the UV-curable additive.

15 Claims, 4 Drawing Sheets

LIQUID DEVELOPERS WITH UV CURABLE ADDITIVES AND METHODS FOR THEIR PREPARATION

RELATED APPLICATIONS

This application derives priority from U.S. patent application Ser. No. 11/524,019 filed Sep. 20, 2006, now U.S. Pat. No. 7,544,458 and is a continuation in part of the above mentioned U.S. patent application and of International patent application No. PCT/US2005/026627 filed Jul. 27, 2005, the disclosures of both of which are incorporated herein by reference.

FIELD OF THE INVENTION

The invention relates to liquid developers for electrography, and particularly to such developers that include UV-curable components.

BACKGROUND OF THE INVENTION

In many printing systems, it is common practice to develop a hardcopy of an image using a photoconductive surface. The photoconductive surface is selectively charged with a latent electrostatic image having image and background areas. A liquid developer comprising charged toner particles in a carrier liquid is brought into contact with the selectively charged photoconductive surface. The charged toner particles adhere to the image areas of the latent image while the background areas remain clean. A hardcopy material (e.g. paper) is brought, directly or indirectly, into contact with the photoconductive surface in order to transfer the latent image. Variations of this method utilize different ways for forming the electrostatic latent image on a photoreceptor or on a dielectric material.

Typically the liquid developer (also referred to in the art as liquid toner) comprises a thermoplastic resin (polymer) as the basis for the toner particles (also referred to in the art as ink particles), and a non-polar liquid as a carrier liquid in which the toner particles are dispersed. Generally, the toner particles contain a colorant such as a pigment.

U.S. Pat. No. 5,212,526 describes a method and device for simultaneously transferring and fusing an image from an image receptor to a recording medium. The method includes forming a toned image layer on a surface of an image receptor, the toned image layer comprising a toner material and a radiation curable material. The toner may be dry or liquid.

U.S. Pat. No. 6,837,839 describes a method for printing an image on a page by an electrophotography process comprising transferring a toner image to a page, and separately fusing the toner to the page by applying UV light to the toner. The toner is especially formulated to facilitate curing and/or fusing of the toner to paper. It is mentioned that the toner may include toner particles suspended in a UV curable resin.

JP 61-156262 describes a liquid developer for electrostatic photography having toner particles that comprise a coloring agent and a copolymer of mono-functional and multi-functional (meth)acrylates. The multi-functional (meth)acrylates mentioned, have between 2 and 4 functional groups. The reference states that suitable proportions of multi-functional (meth)acrylates to mono-functional (meth)acrylates are in the range of about 0.01-1:1 (by weight).

SUMMARY OF THE INVENTION

An aspect of some embodiments of the invention relates to a method for printing an image with a liquid developer having a UV-curable additive in the toner particles. The method includes at least partially fixing an image to a substrate, for example paper, and then curing the UV-curable additive. In some embodiments, the UV-curing is carried out in-line, at the speed of the printing process. Optionally, the irradiation is within a minute or less, optionally 10 seconds or less, after the image is transferred to the substrate.

In some cases, images printed by a method according to embodiments of the invention were found to exhibit improved abrasion and/or peeling resistance.

Another aspect of some embodiments of the invention, relates to a method for printing an image with a liquid developer having a UV-curable additive in the toner particles, wherein the UV-curable additive comprises multi-functional acrylates. Optionally, the carrier liquid is free of multi-functional acrylates.

A preferred embodiment of the invention embodies the two above-mentioned aspects, and includes at least partially fixing an image to a substrate, the image comprises toner particles with a multi-functional acrylate as a UV-curable additive, and then curing the additive.

In the context of the present invention, a multi-functional acrylate is an acrylate with 4-6 or more functional groups, preferably 6 functional groups. Optionally, the toner particles are substantially free of mono-functional acrylates, since they are less reactive than multi-functional ones. In this context, substantially free means that mono-functional acrylates make less than 10%, optionally less than 1% of the acrylates in the toner particles.

An aspect of some embodiments of the invention concerns compositions of liquid developers having a multi-functional acrylate as a UV-curable additive in the toner particle and/or in the carrier liquid. In the toner particles polyester acrylates are preferred, while in the carrier liquid polyurethane acrylates are preferred. Methacrylates are not suitable for replacing the above-mentioned acrylates as they were found to cure too slowly.

The UV curable additives preferably have good wetting properties towards the pigment. Good wetting properties mean that they physically attach to pigment surface allowing high degree of dispersability and good grinding conditions. Some examples of UV curable additives with generally good pigment-wetting properties are multi-functional urethane acrylates and multi-functional polyester acrylates.

In a first exemplary embodiment, the UV-curable additives are incorporated in the toner particles, and are selected from hexa-functional acrylates, multi-functional polyester acrylates and multi-functional polyurethane acrylates.

Preferably, a stabilizer is added to the composition of the toner particles to inhibit any initiation of curing in the absence of strong UV irradiation. Strong UV irradiation is, for instance, between about 200 and about 400 mJ/cm$^2$ (to be measured on top of the printed surface). As UV-curing is many times initiated by free radicals, the stabilizer optionally comprises a free radical scavenger.

In a second exemplary embodiment, the UV-curable additives are present in the carrier liquid.

In a third embodiment, UV-curable additives present in both the toner particles and in the carrier liquid.

Optionally, photo initiators are included in the composition of the liquid developer. A photo-initiator is a compound that, when irradiated with light, readily produces free radicals that initiate the curing process. Preferably, the wavelength at which UV irradiation is applied for curing and the wavelength at which the photo-initiators produce free radicals are selected to match each other.

Preferably, the photo initiator is added after grinding, for instance, to the liquid carrier. Adding the photo initiator in the grinding stage might cause, with some initiators, premature initiation of a polymerization reaction by heat that develops during grinding. When the toner particles are dispersed in the liquid carrier, some of the initiator migrates to the toner particles, or attached to them, so upon UV irradiation, the photo initiator put into the carrier can initiate a reaction of the UV-curable additive, put into the toner particle.

In the above-mentioned second embodiment, it is preferred to include acrylates of lower functionality (that is, mono-acrylates or bi-acrylates) in the liquid carrier, as they are useful to enhance the incorporation of the UV-curable additives and/or of the photo-initiators into the liquid carrier. Bi-acrylates are preferred, as they were found to be more reactive than mono-acrylates. Optionally, the ratio between multi-functional acrylates and acrylates of lower functionality is preferably from 1:5 to 1:20, more preferably from 1:8 to 1:12.

Without being bound to theory, it is suggested that the lower acrylates are useful because of their lower viscosity on one hand, and compatibility with the higher acrylates, on the other hand. Lower viscosity, in this context, is about 30 cps or lower at room temperature. In this application room temperature is about 25° C.

The following are examples of some powder photo initiators which can be dissolved in low viscosity acrylates and be used in embodiments of the present invention: Irgacure 369, 651, 184, 1300, 819, Darocur TPO—all from Ciba, and Additol EPD. All the above-mentioned are manufacture by Ciba, except for the last one, which is manufactured by Cytec (formerly UCB).

Another aspect of some embodiments of the present invention is a method of making toner particles with a UV-curable additive, the method comprising grinding a pigment with a thermoplastic resin and the UV-curable additive. The UV curable additive comprises at least 75% multi-functional acrylates. Hexa-functional acrylates are preferred, and so are polyester acrylates. Optionally, the pigment, thermoplastic resin, and UV-curable additive are ground together with other ingredients known in the art to be incorporated in a toner particle during grinding, such as a charge adjuvant. The grinding is in the presence of a liquid, optionally the liquid is the liquid carrier, for instance, Isopar®.

Another aspect of some embodiments of the present invention is a one-phase liquid carrier for liquid toner particles, comprising a non-polar liquid and multi-functional acrylates. In an embodiment of the invention, the multi-functional acrylates constitute about 0.05% to about 0.5% (w/w) of the liquid carrier. Preferably, the UV curable additive in the carrier liquid has an evaporation rate substantially smaller than that of some other liquid components of the carrier liquid, and the developed image is heated before being irradiated with UV, such that evaporation of the more volatile liquid components of the carrier liquid takes place. In this way, the concentration of the UV-curable additive in the image is increased to a concentration at which effective curing can take place. A carrier liquid with low concentration of UV-curable additives which are less volatile than other liquid components of the carrier liquid may give excellent results also with UV-curable additives different than those described herein, for instance, with the additives described in copending U.S. patent application Ser. No. 11/524,019 and International patent application No. PCT/US2005/026627.

As the multi-functional acrylates are insoluble with many non-polar liquids, and in particular in ISOPAR®-L, which is often used as a main constituent of liquid developers, providing such a one-phase liquid carrier requires a unique preparation method.

Thus, another aspect of some embodiments of the present invention is a method for preparing a one-phase liquid carrier comprising a non-polar liquid and a multi-functional acrylate. In this context, the one phase is determined by visual examination, that is, a liquid carrier that looks clear is considered one-phase. The method comprises preparation of a mixture of multi-functional acrylates mixed with—and optionally dissolved in acrylates of lower functionality to obtain an acrylate mixture, and then diluting this mixture with the non-polar liquid. Preferably, the dilution is made in two stages: first, the acrylate mixture is diluted with a first quantity of non-polar liquid and mixed in a high shear mixer to obtain a concentrated carrier, and then, the concentrated carrier is diluted to final concentration of acrylates, optionally, with regular stirring. In the obtained developer, the acrylate concentration is about 2% (w/w of the carrier liquid), generally between 0.5% and 5%. In some embodiments, about 10% of the acrylates in the liquid carrier are multi-functional acrylates.

Thus, an aspect of some embodiments of the present invention relates to a method for printing a substrate by liquid developer electrography, the method comprising:

(a) developing a latent image with liquid developer comprising toner particles dispersed in a carrier liquid, said toner particles comprising UV-curable additive;

(b) transferring the developed image to the substrate;

(c) at least partially fixing the image to the substrate; and (d) irradiating the at least partially fixed image with UV radiation to cure the UV-Curable additive.

Another aspect of some embodiments of the present invention relates to a method for printing a substrate by liquid developer electrography, the method comprising:

(a) developing a latent image with liquid developer comprising toner particles dispersed in a carrier liquid, said toner particles comprising as a UV-curable additive a substance selected from: a hexa-functional acrylate or a multi-functional polyester acrylate;

(b) transferring the developed image to the substrate; and (c) irradiating the image with UV radiation to cure the UV-Curable additive. Optionally, before irradiating the image in (c) the image is at least partially fixed to the substrate.

An aspect of some embodiments of the present invention relates to a method for printing a substrate by liquid developer electrography, the method comprising:

(a) developing a latent image with liquid developer comprising toner particles dispersed in a carrier liquid, said carrier liquid comprising a multi-functional acrylate as a UV-curable additive;

(b) transferring the developed image to the substrate; and (c) irradiating the image with UV radiation to cure the UV-Curable additive. Optionally, before irradiating the image in (c) the image is at least partially fixed to the substrate.

In exemplary embodiments of the invention, the carrier liquid and the toner particles comprise UV curable additives. Preferably, the UV curable additive is present in a percentage of 0.5% to 5% by weight of the carrier liquid.

In a preferred embodiment of the present invention, the UV curable additive in the carrier liquid has an evaporation rate substantially less than that of at least some other liquid components of the carrier liquid and after the developing and prior to the irradiating a portion of the other liquid components is evaporated, such that the concentration of UV curable additive is increased by an amount such that UV irradiation is effective to cure the curable additive.

Optionally, the fixing of the image to the substrate includes irradiating the image with IR radiation. Alternatively or additionally, the fixing includes heating the image and the substrate. Alternatively or additionally said fixing includes pressing the image against the substrate utilizing a heated member.

Optionally, in embodiments of the invention, transferring comprises:

first transferring the developed image to an intermediate transfer member on which the image is heated; and transferring the heated image to a final substrate by pressing the heated image against the final substrate.

In exemplary embodiments of the invention, the image is at least partly fused to the substrate prior to being irradiated with UV irradiation.

Optionally, the UV irradiating is carried out within 10 seconds of the transfer to the substrate.

In preferred embodiments of the invention the UV-curable additive comprises a multi-functional acrylate.

An aspect of some embodiments of the invention concerns a method for making toner particles, the method comprising grinding together a mixture comprising a thermoplastic resin swelled with an aliphatic liquid (which optionally is isoparaphinic), a pigment, and a UV-curable additive. Preferably, the UV-curable additive comprises multi-functional acrylate.

An aspect of some embodiments of the invention concerns a method for making a liquid developer, the method comprising making toner particles in a method according to embodiments of the invention, and dispersing the toner particles in a liquid carrier. Optionally, the aliphatic liquid is the same as the liquid carrier. Optionally, the method comprising mixing a photo-initiator with an acrylate of lower functionality, and adding the obtained mixture to the liquid carrier. Optionally, thermoplastic resin is a copolymer of ethylene with acrylic or methacrylic acid.

An aspect of some embodiments of the present invention concerns a method of making a one-phase liquid carrier comprising a non-polar liquid and a multi-functional acrylate, the method comprising:

(a) mixing the multi-functional acrylate with acrylates of lower functionality to obtain an acrylate mixture, and (b) diluting the obtained mixture with the non-polar liquid, optionally to a concentration of 0.5-5% acrylates in the liquid carrier.

In exemplary embodiments, (b) comprises:

(b.1) mixing in a high shear mixer the acrylate mixture with a first quantity of non-polar liquid to obtain a concentrated carrier; and (b.2) diluting the concentrated carrier with a second quantity of non-polar liquid.

Optionally, the non-polar liquid is an isoparaphinic liquid.

Optionally, the diluting is

Preferably, the multi-functional acrylate is tetra-functional, penta-functional, or hexa-functional. In some embodiments, hexa-functional acrylates are preferred.

Optionally, the multi-functional acrylate is a polyester acrylate; alternatively or additionally, it is a polyurethane acrylate.

An aspect of some embodiments of the invention concerns a one phase liquid carrier comprising multi-functional acrylates, optionally polyurethane acrylate, alternatively or additionally, a hexa-functional acrylate. Optionally, the one phase liquid carrier further comprises acrylates of lower functionality, preferably bi-functional acrylates.

In exemplary embodiments of the invention, the multi-functional acrylates together with the acrylates of lower functionality form from 0.5% to 5% of the liquid carrier. Preferably, the ratio between multi-functional acrylates and acrylates of lower functionality is from 1:5 to 1:20.

Some embodiments of the invention relate to a liquid developer comprising toner particles dispersed in a liquid carrier, the liquid carrier being according to any embodiment of the invention.

An aspect of some embodiments of the invention concerns a liquid developer comprising toner particles dispersed in a liquid carrier, wherein the toner particles include a thermoplastic resin, a pigment, and a UV-curable additive selected from: a hexa-functional acrylate, a multi-functional polyurethane acrylate or a multi-functional polyester acrylate. Preferably, the UV-curable additive wets the pigment. In exemplary embodiments, the UV-curable additive comprises a polyester acrylate. Optionally, the UV-curable additive comprises a hexa-functional polyester acrylate and/or other hexa-functional acrylates and/or tetra-functional acrylates. Optionally, the UV-curable additive makes 0.5 to 5% of the non-volatile solids in the toner particles.

In exemplary embodiments, the liquid carrier comprises photo-initiators and an acrylate of lower functionality, preferably, a bi-functional acrylate. Optionally, the acrylate of lower functionality has at room temperature a viscosity of up to 30 cps.

Optionally, the thermoplastic resin comprises a copolymer of ethylene with acrylic or methacrylic acid.

Optionally, the toner particles in developers or methods according to embodiments of the invention are tentacular.

Optionally the liquid carrier of the developer according to the invention is a liquid carrier according to the invention.

BRIEF DESCRIPTION OF THE FIGURES

In order to better understand the invention and to see how it may be carried out in practice, some embodiments will be described below as non-limiting examples only, with the assistance of the Figures, wherein.

DETAILED DESCRIPTION OF EXEMPLARY EMBODIMENTS

Liquid developers that had UV curable additives in the toner particles as described below had a higher abrasion resistance than that obtained with the same developers but without the UV curable additives. The difference was of 20 units using BVS™ paper by Papierfabrik Scheufelen. BVS paper is an acrylic coated paper. Units for measuring abrasion are described below.

Liquid developers that had UV curable additives in the liquid carrier as described below had peeling resistance 100% higher than that obtained with the same developers but without the UV curable additives. The measurements were on uncoated paper (Hadar-Top™ by Hadera Paper, Israel.) Explanation of peeling resistance measurement is provided below.

In the following, described are the preparation of the toner particles and the liquid developer, the printing process, and the printing apparatus used by the inventors in the development of the present invention.

Preparing Toner Particles and Liquid Developer

Figure 1:
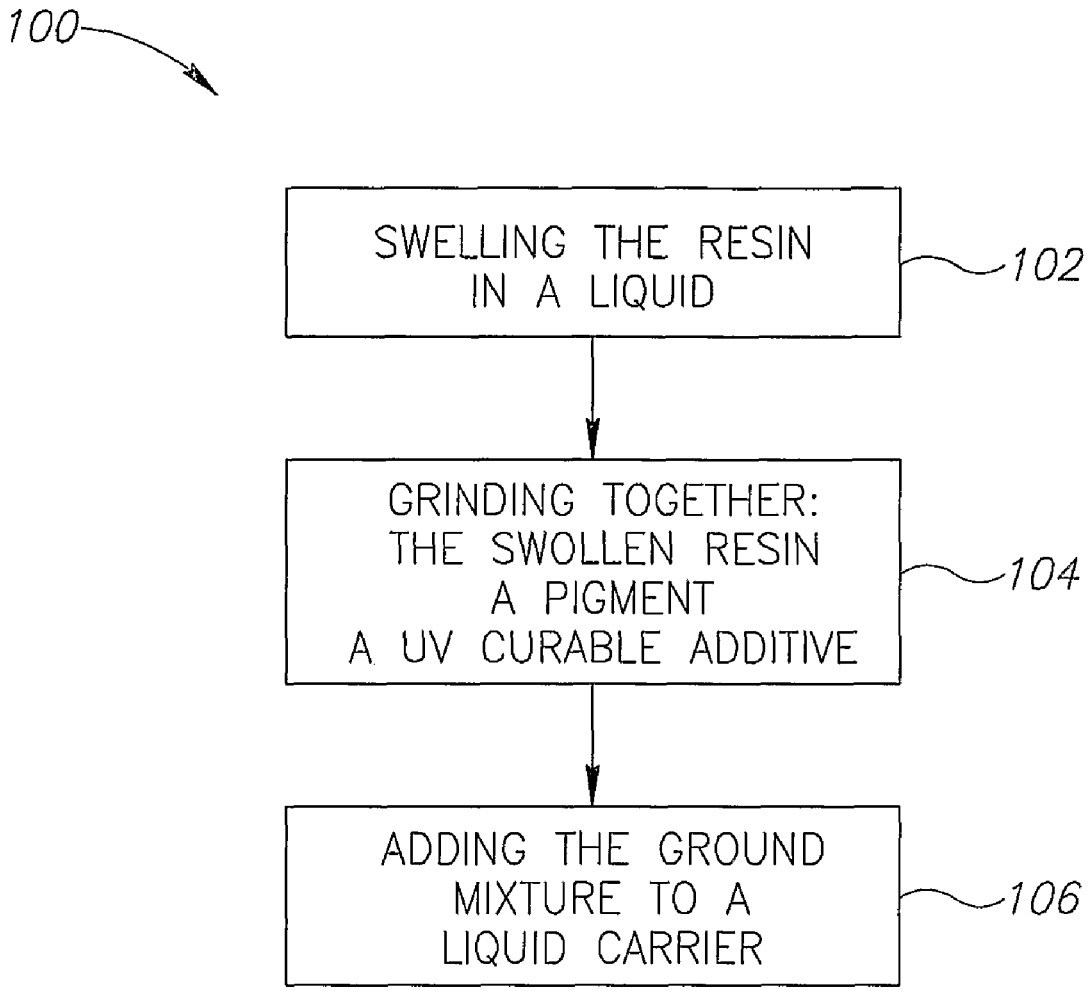
FIG. 1 is a flow chart of a method for preparing toner particles according to an embodiment of the invention.

FIG. 1 is a flow chart of a method (100) for preparing a liquid developer with UV-curable additives according to an embodiment of the invention. This UV developer is referred herein as UV1.

Production of Toner Particles

First, 600 grams of polyethylene-acrylic acid co-polymers (Nucrel 699, DuPont) and 150 grams and ACE5120, DuPont is mixed in a Ross double planetary mixer with 1750 grams of Isopar L (an iso-parafinic oil manufactured by EXXON) carrier liquid at a speed of 60 rpm and a temperature of 130° C. for one hour (102). During this heating the resin solvates carrier liquid and is swelled. The temperature is then reduced and mixing is continued until the mixture reaches room temperature. The end result is a homogeneous paste.

Next (104) 1240 g of the paste prepared in 102 are charged into a Union Process 1S ball attritor together with 55.6 g Toyo Lionel Blue pigment, 4.14 g Heliogen Green pigment, 9.2 g aluminum di-stearate as charge adjuvant and 18.4 g of hexacrylate ebecryl 450 UV-curable additives and 18 mg of NPAL by Albermale as UV-stabilizer. The mixture is ground at 58° C. for 1.5 hours, at 250 rpm, followed by additional grinding at 40° C. for 10.5 hours at 250 rpm to obtain toner particles dispersed in liquid carrier. The toner particles obtained by this process are tentacular.

The percentage of polymer is optionally about 85% (80%-90%), the percentage of aluminum tri-stearate is about 2%, (1%-3%), the percentage of UV-curable additive is about 2% (1%-3%), and the percentage of pigment is about 13% (10%-20%) all by weight of the NVS. The amounts in parentheses are preferred, but not limiting ranges of each of the component materials.

In practice, toner compositions can vary depending on the characteristics, color, etc. desired, so that in some situations the percentages can vary within (or even outside) the ranges given in parentheses after each percentage component. In addition, the type of polymer used and other components can vary, as known in the art.

The dispersed toner particles in the liquid carrier are charged utilizing 30 (5-40) mg solids of charge director per g toner solids. Also added is a photoinitiator mixture, in an amount of 0.2% (0.1-0.4) of the liquids in the formulation.

The photoinitiator mixture is prepared by mixing 90 grams of DPGDA (Dipropylene Glycol Diacrylate by UCB) with 10 g of a 1:1 mixture of TPO and Darcur 1173 (two photoinitiators by Ciba (Darocur 1173 is 2-Hydroxy-2-methyl-1-phenyl-propan-1-one, and TPO is diphenyl(2,4,6-trimethylbenzoyl)phosphine oxide) for half an hour at 60 rpm using simple magnetic stirrer at 50° C.

The charged toner particles with the photoinitator mixture are diluted (106) with additional Isopar L and Marcol 82 (EXXON) to produce a toner having a 2% NVS, with 98% (optionally 97%-100%) of the carrier liquid being Isopar L and 2% (optionally 0-3%) Marcol 82. A commercially available charge director (HP Indigo Imaging Agent 4.0) was used in the experiments. Other charge directors as known in the art can also be used.

The result is a cyan toner. All of the experiments reported below were with cyan toner, although the inventive concepts can be applied to other color toners, for which different pigments would be used, as well.

Other suitable UV-curable additives include: Ebectryl 812, (tetrafunctional functional polyester acrylates by UCB), IRR 182, Ebecryl 450, Ebecryl 860 and Ebecryl 3201, all by UCB, and CN9006 (hexa-functional urethane acrylate), CN 2200 (polyester acrylate oilgomer), CN 2902 (aromatic urethane acrylate), and CN 2100 (amine modified epoxy acrylate). Ebecryl products are by UCB, and CN products are by Sartomer.

It should be understood that different pigments may be better wetted by other UV-curable additives.

The Printing Process

In printing experiments, latent image was developed with the above-described developers, transferred to paper, fixed, and then irradiated with UV. Such a process may be carried out with any known methods for forming latent image, developing latent images, transferring developed images to substrates, and fixing the image to the substrate. In the experiments described below, a HP 5000 Press was used.

Figure 2:
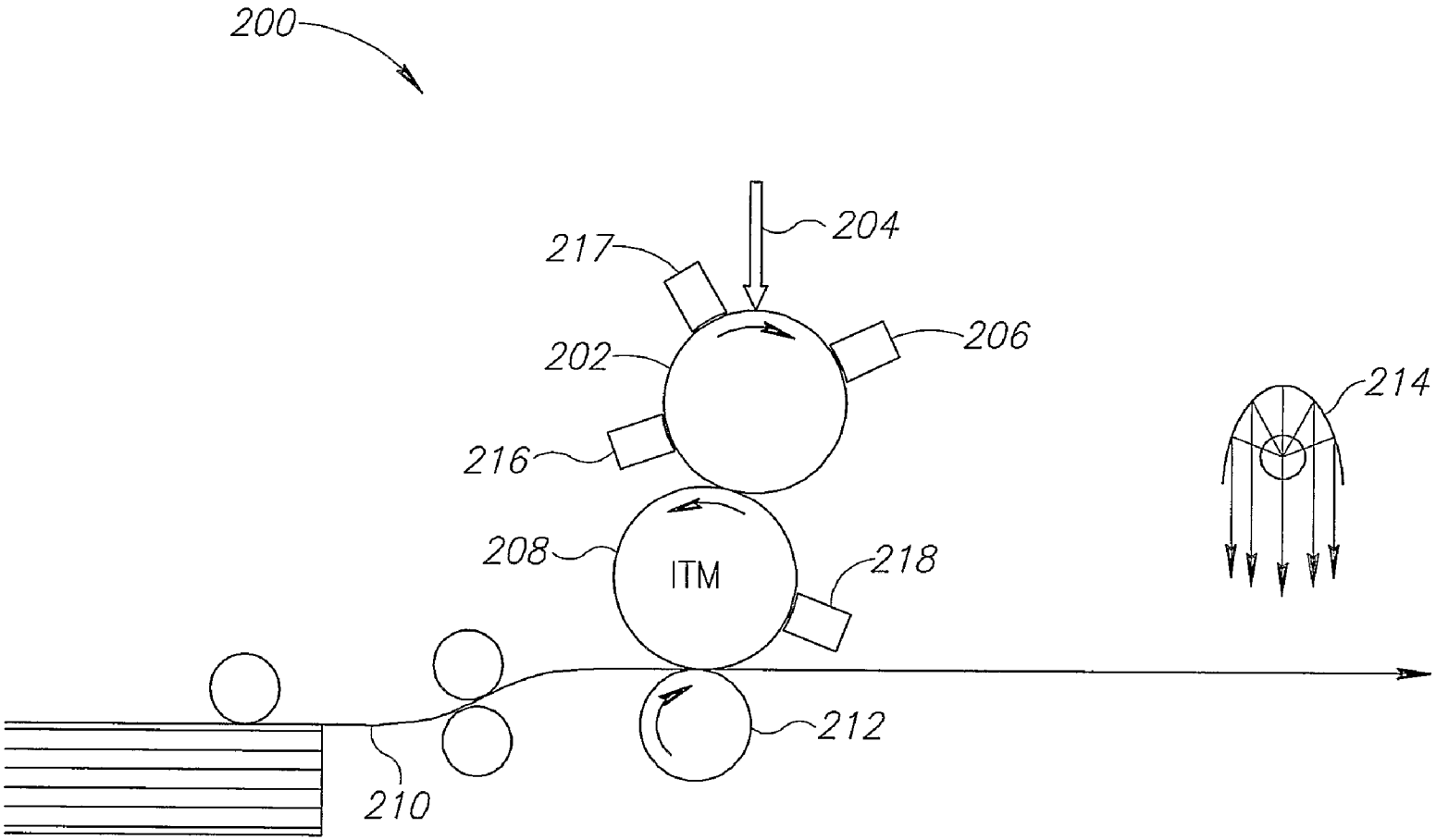
FIG. 2 is a schematic illustration of a printing machine having a UV source, for in-line UV curing.

Fixing is preferably carried out by heat and pressure, for example, during transfer of the image from a heated intermediate transfer member under pressure. In some embodiments of the invention curing may be obtained fast enough to be carried out in-line, at the speed of the printing process. A printer 200, with UV-lamp suitable for such in-line curing is schematically shown in FIG. 2. The printer includes a photoreceptor 202 charged by a charger 217, on which a laser (204) creates a latent image comprising pixels charged at to different voltages. This latent image is developed by a developer or toner applied by a developer apparatus (206), which can be of any form known in the art. The developed image is transferred to an intermediate transfer member (ITM) 208, which transfers the image to a substrate 210, such as paper. During the transfer to the substrate, the image is pressed between heated ITM (208) and a pressure cylinder (212), and continues moving towards a UV lamp (214), which cures the UV-curable additive to provide an image with improved rub-resistance and peeling resistance. The printer 200 also includes a cleaning station 216 of any type known in the art for cleaning the photoreceptor. Optionally, it also includes a cleaning station 218 to remove residual toner from the ITM. In some embodiments of the invention the image is at least partially fixed and fused during transfer to the substrate, by heat and pressure.

Figure 3:
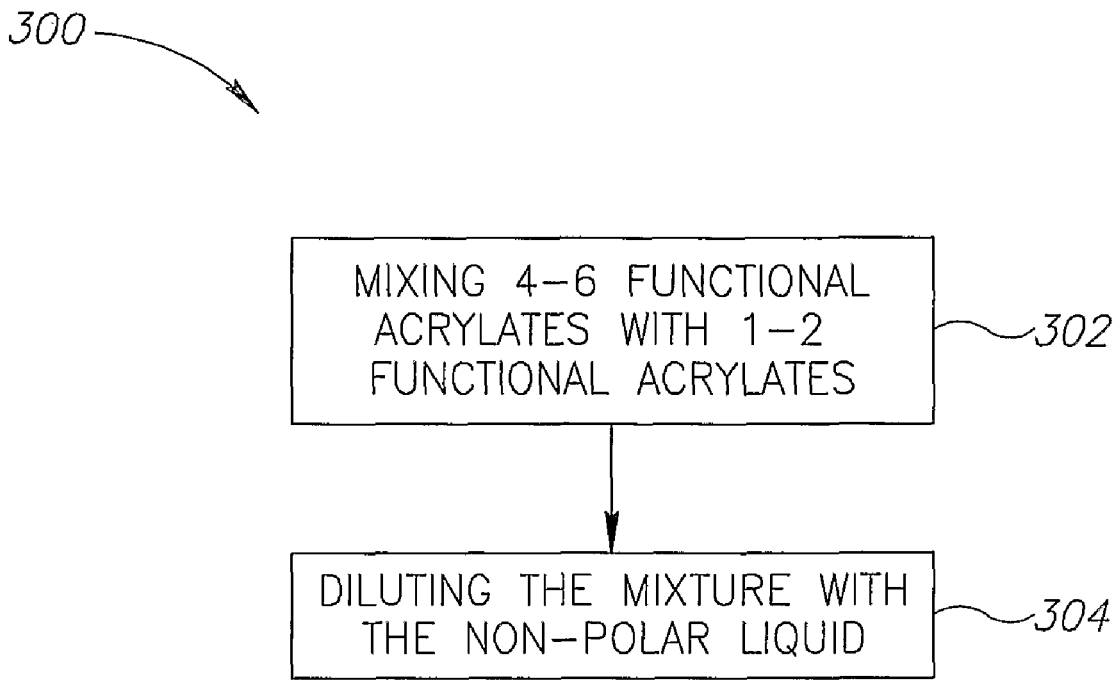
FIG. 3 is a flow chart of a method for dissolving a multi-functional acrylate in non-polar liquids according to an embodiment of the invention.
Figure 4:
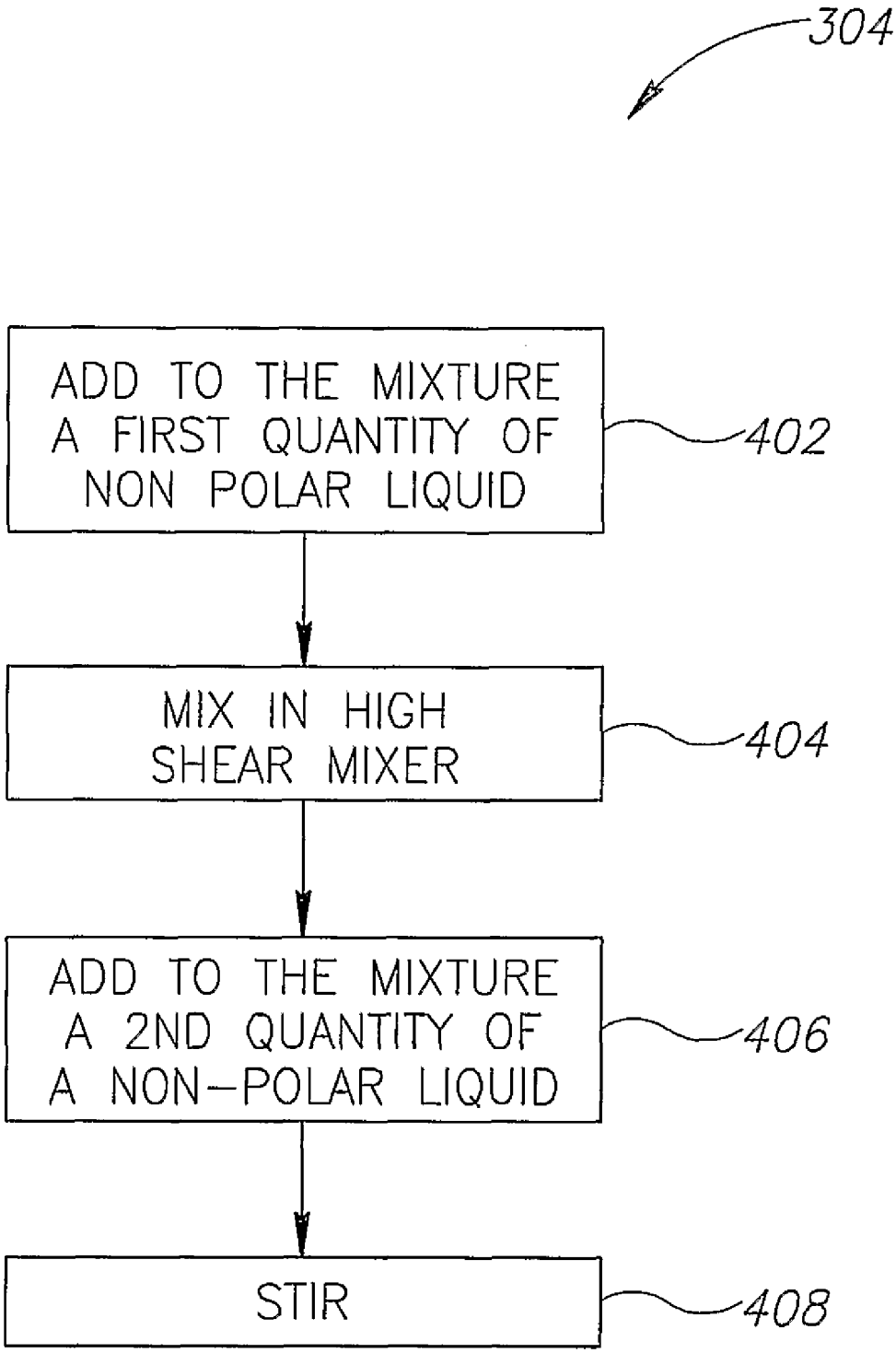
FIG. 4 is a flow chart of one of the steps in the method of FIG. 3, according to an embodiment of the invention.

FIG. 3 is a flow chart of a method (300) for incorporating multi-functional acrylates into a non-polar liquid according to an embodiment of the invention. The method (300) comprises mixing (302) multi-functional acrylates with acrylates of lower functionality to obtain an acrylate mixture, and then diluting (304) this mixture with the non-polar liquid. Preferably, the dilution (304) is made in two stages, as illustrated in FIG. 4: first, a quantity of non-polar liquid is added (402) to the mixture; then mixed (404) in a high shear mixer to obtain a concentrated carrier, and then, a second quantity of non-polar liquid is added (406) to the concentrated carrier as to obtain a final concentration of acrylates, optionally with regular stirring (408).

Examples of Liquid Developers with UV-Curable Additives in the Toner Particles

Example 1

The above-described UV1 developer was tested in a HP 5000 Press, that was equipped with a UV curing unit (Light Hammer, from Fusion), including a 6 inch, 480 W/inch D bulb and a paper transport unit, and printed at a process speed of 1.2 m/sec.

Example 2

A similar developer was tested (hereinafter UV2), but the UV curable additive was CN9006, a hexafunctional aliphatic urethane acrylate oligomer by Sartomer, and the photoinitator mixture was made of 90% isodecyl acrylate (mono-actylate by UCB) and 10% of 1:1 mixture of EPD and ITX (a photo-initiator and a co-initiator by UCB). EPD is Ethyl-4-(dimethylamino) benzoate, and ITX is Isopropyl thioxanthone.

In this experiment, the UV curing unit included a 6 inch, 480 W/inch H lamp, providing the UV spectrum of Hg.

Results Obtained with the Developers of Examples 1 and 2

The abrasion resistance of images printed on three different papers was measured (see below for details) and compared to that of images printed with the same developer but without the UV-curable additive and without the photoinitiator-mixture (hereinafter "reference"). The papers were: Condat-Gloss™ (an SBR (styrene butadiene rubber) coated paper), BVS (an acrylic coated paper), and Hadar-Top (a non-coated paper).

The results are presented in the following table. The figures in the table represent the percentage of the damaged area.

| | Condat paper | BVS paper | HT paper |
|---|---|---|---|
| Reference | 30 | 48 | 27 |
| UV1 | 22 | 25 | 20 |
| UV2 | 20 | 24 | 24 |

Example of UV-Curable Additives in the Carrier Liquid

Example 3

8.33 g Ebecryl 1290 (hexa-functional urethane acrylate by UCB) are added to 83.33 g DPDGA (Dipropylene Glycol Diacrylate by UCB) mixed with a magnetic stirrer for half an hour, at 50° C. and maximum speed. The Ebecryl dissolves in the DPDGA.

91.66 g Isopar™-L and to 0.14 g of NPAL stabilizer are added and mixed at a high shear mixer (Kady mill or Ross Mill) at more than 6,000 rpm for 2 minutes at Room temperature. Before the high shear mixing the particles size of the high acrylate was measured to be around 400 nm, and after high shear mixing, around 0.66 nm. The sub-nanometric size was measure with a Zeta™ nanosizer by Malvern.

Additional Isopar™-L is added to obtain a mixture with 2% acrylate (w/w), which is stirred with a magnetic stirrer for about 10-20 minutes at room temperature. The obtained liquid is single-phase, and no phase-separation is observed by the naked eye.

Optionally, a photoinitiator with or without a co-initiator, and a stabilizer for stabilizing the UV formulation, are also added to the mixture. The stabilizer is added to ensure that small amounts of free radicals that may be produced due for, for instance, exposure to sun light, would not cause the UV-curable additive to cure. The stabilizer is added to the toner particle in the grinding stage, and the photoinitiator is added to the liquid carrier.

Results Obtained with the Developer of Example 3

A developer was prepared as in the reference developer of example 1 above, but with ISOPAR-L that contained 2% acrylates, and prepared in the dilution method described above.

The developer was tested in an HP 5000 Press equipped with in-line UV curing unit as in example 1 above, with a D bulb, at printing (and curing) rate of 1.2 m/s, with three kinds of paper: Condat-SBR coated paper; BVS (acrylic coated paper); and Hadar Top (uncoated paper); all supplied by Margol, Israel.

The results obtained with the formulation of example 3 are reproduced in the following table. The numbers represent damaged area out of total area, in percentages.

| | Condat gloss 170 | | BVS | | Hadar-Top |
|---|---|---|---|---|---|
| | Flaking | Peeling | Flaking | Peeling | Flaking |
| UV(a) | 0.101 | 1.5 | 0.93 | 19.6 | 0.023 |
| Ref | 1.4 | 3.4 | 5.6 | 37.4 | 0.121 |

Results of abrasion resistance are provided in the following table:

| | Condat | BVS | Hadar-Top |
|---|---|---|---|
| UV(a) | 45.8 | 64.3 | 33.7 |
| Ref | 67.9 | 78.6 | 39.6 |

Testing Methods

Abrasion resistance was quantitatively defined by a test based on ASTM D 5264-92 standard.

Peeling damage was quantitatively defined by the following test: an image having 100% coverage is printed on the paper, and a scotch-tape is adhered to it and attached with a standard weight that is rolled on it for ten times. Then, the tape is removed manually, and the image is analyzed for percentage of damaged (white) area.

Flaking damage was quantitatively defined by the following test: two images (each on a separate paper) having 200% coverage were attached one to a table, and one to a side of a book. The book was moved against the table for 50 times, with the two images one against the other. Then, the lower image, the is, the one attached to the table, is analyzed for percentage of damaged (white) area.

Examples 4-5

Two other formulations were prepared similar to the one of example 3, with the following constituents:

Formulation (b): Ebecryl 1290: 7.14 g; Additols (which is a 1:1 mixture of ITX and EPD, a photo-initiator and a co-initiator by UCB) 7.14 g; DPGDA 85.56 g; and stabilizer: 0.15 g.

Formulation (c): like formulation (b) but 7.14 g of the DPGDA were replaced with the same weight of CN152 (an aliphatic acrylate oligomer by Sartomer).

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

The invention claimed is:

1. A method for printing a substrate by liquid developer electrography, the method comprising:

(a) developing a latent image with liquid developer comprising toner particles dispersed in a carrier liquid, said toner particles comprising a thermoplastic resin, a pigment, and a UV-curable additive selected from a multi-functional polyurethane acrylate or a multi-functional polyester acrylate;

(b) transferring the developed image to the substrate;

(c) at least partially fixing the image to the substrate; and (d) irradiating the at least partially fixed image with UV radiation to cure the UV-curable additive.

2. A method according to claim 1 wherein said carrier liquid comprises a UV curable additive.

3. A method according to claim 1, wherein the UV irradiating is carried out within 10 seconds of the transfer to the substrate.

4. A method according to claim 1, wherein the UV-curable additive comprises a multi-functional acrylate.

5. A method for printing a substrate by liquid developer electrography, the method comprising:

(a) developing a latent image with liquid developer comprising toner particles dispersed in a carrier liquid, said toner particles comprising a thermoplastic resin, a pigment, and a UV-curable additive selected from a multi-functional polyurethane acrylate or a multi-functional polyester acrylate;

(b) transferring the developed image to the substrate; and (c) irradiating the image with UV radiation to cure the UV-curable additive.

6. A method according to claim 5, wherein before irradiating the image in (c) the image is at least partially fixed and/or at least partly fused to the substrate.

7. A method for making toner particles, the method comprising grinding together a mixture comprising: a thermoplastic resin swelled with an aliphatic liquid; a pigment; and a UV-curable additive selected from a multi-functional polyurethane acrylate or a multi-functional polyester acrylate.

8. A method according to claim 7, wherein the UV-curable additive is a hexa-functional polyester acrylate.

9. A liquid developer comprising toner particles dispersed in a liquid carrier, wherein the toner particles include a thermoplastic resin, a pigment, and a UV-curable additive selected from a multi-functional polyurethane acrylate or a multi-functional polyester acrylate.

10. A liquid developer according to claim 9, wherein the multi-functional polyester acrylate is a hexa-functional polyester acrylate.

11. A liquid developer according to claim 9, wherein the liquid carrier comprises photo-initiators and an acrylate having a mono-functionality or a bi-functionality.

12. A liquid developer according to claim 11, wherein the acrylate having the mono-functionality or the bi-functionality has at room temperature a viscosity of up to 30 cps.

13. A liquid developer according to claim 9, wherein the toner particles are tentacular.

14. A liquid developer according to claim 9 wherein the liquid carrier is a one-phase liquid carrier comprising mono-acrylates or bi-acrylates.

15. The liquid developer according to claim 9 wherein:

the thermoplastic resin is present in an amount ranging from about 80% to about 90% by weight of the toner particles;

the pigment is present in an amount ranging from about 10% to about 20% by weight of the toner particles; and the UV-curable additive is present in an amount ranging from about 1% to about 3% by weight of the toner particles.

* * * * *